US010226712B2

(12) United States Patent
Podd

(10) Patent No.: US 10,226,712 B2
(45) Date of Patent: Mar. 12, 2019

(54) WALKING ANIMAL TOY APPARATUS AND METHODS OF MAKING AND USING THE SAME

(71) Applicant: George O. Podd, Lake Forest, IL (US)

(72) Inventor: George O. Podd, Lake Forest, IL (US)

(73) Assignee: VIA, LLC, Lake Forest, IL (US)

( * ) Notice: Subject to any disclaimer, the term of this patent is extended or adjusted under 35 U.S.C. 154(b) by 220 days.

(21) Appl. No.: 15/245,340

(22) Filed: Aug. 24, 2016

(65) Prior Publication Data

US 2017/0056780 A1 Mar. 2, 2017

Related U.S. Application Data

(60) Provisional application No. 62/283,167, filed on Aug. 24, 2015.

(51) Int. Cl.

| | |
|---|---|
| ***A63H 7/04*** | (2006.01) |
| ***A63H 11/20*** | (2006.01) |
| ***A63H 7/06*** | (2006.01) |
| *A63H 3/28* | (2006.01) |

(52) U.S. Cl.

CPC ..... *A63H 11/20* (2013.01); *A63H 7/06* (2013.01); *A63H 3/28* (2013.01)

(58) Field of Classification Search

USPC ..... 446/269, 274–277, 279, 280, 285, 446/292–294, 355, 356, 376, 377

See application file for complete search history.

(56) References Cited

U.S. PATENT DOCUMENTS

| | | | | | |
|---|---|---|---|---|---|
| 1,605,307 | A | | 11/1926 | Walker | |
| 1,849,533 | A | | 3/1932 | Parton | |
| 2,168,425 | A | | 8/1939 | Sleeseman | |
| 2,180,623 | A | * | 11/1939 | Allen | A63H 7/06 446/293 |
| 2,496,766 | A | | 2/1950 | Wood | |
| 2,605,585 | A | * | 8/1952 | Sebel | A63H 7/04 446/294 |
| 2,971,289 | A | * | 2/1961 | Reed | A63H 3/12 446/289 |
| 2,983,072 | A | * | 5/1961 | Crawford | A63H 3/31 446/189 |
| 3,163,960 | A | * | 1/1965 | Keikichi Iwaya | A63H 31/00 446/272 |
| 3,178,853 | A | | 4/1965 | Greenwood et al. | |
| 3,346,990 | A | * | 10/1967 | Holt | A63H 7/04 446/274 |
| 3,492,759 | A | * | 2/1970 | Lemkin | A63H 7/04 446/269 |
| 3,760,532 | A | | 9/1973 | Campion | |
| 4,018,002 | A | | 4/1977 | Holden | |
| 4,245,425 | A | * | 1/1981 | D'Andrade | A63H 3/28 446/271 |
| 4,463,514 | A | * | 8/1984 | Nagai | A63H 13/02 446/294 |

(Continued)

*Primary Examiner* — Kurt Fernstrom

(74) *Attorney, Agent, or Firm* — Scherrer Patent & Trademark Law, P.C.; Stephen T. Scherrer; Monique A. Morneault

(57) ABSTRACT

Mechanical toy animals include internal mechanisms that allow the toy animals to simulate live animals. The present invention allows children to physically "walk" the toy animal on a leash. Methods of making and using the same are further provided.

20 Claims, 13 Drawing Sheets

(56) References Cited

U.S. PATENT DOCUMENTS

| | | | | |
|---|---|---|---|---|
| 4,657,098 | A * | 4/1987 | Wilcox | B62D 57/02 180/8.1 |
| 5,100,362 | A | 3/1992 | Fogarty et al. | |
| 5,205,775 | A * | 4/1993 | Brodrib | A63H 3/46 446/278 |
| 5,713,780 | A | 2/1998 | Gallagher | |
| 6,004,185 | A | 12/1999 | Rehkemper et al. | |
| 6,165,043 | A | 12/2000 | Terzian et al. | |
| 6,273,782 | B1 | 4/2001 | Chan et al. | |
| 6,648,720 | B1 * | 11/2003 | Domingues | A63H 11/205 446/352 |
| 7,115,014 | B2 * | 10/2006 | McGrath | A63H 3/24 446/356 |

* cited by examiner

WALKING ANIMAL TOY APPARATUS AND METHODS OF MAKING AND USING THE SAME

The present invention claims priority to U.S. Provisional Pat. App. No. 62/283,167, titled "Force and Management Apparatus for Animal Walking Toy," filed Aug. 24, 2015, which is incorporated herein by reference in its entirety.

TECHNICAL FIELD

The present invention relates to mechanical toy animals. More specifically, the toy animals of the present invention include internal mechanisms that allow the mechanical toy animals to simulate live animals. The present invention allows children to physically "walk" the toy animal on a leash. Methods of making and using the same are further provided.

BACKGROUND

It is, of course, generally known that individuals, specifically, children, enjoy interacting with a toy animal. Indeed, toy animals have been highly marketable for a long time and are popular today as shown by ongoing product sales in the toy industry.

Generally, children love animals, and especially toy-themed versions of animals including: dogs, cats, teddy bears, horses, birds, reptiles, alligators, turtles, lady bugs, farm animals, forest animals, jungle animals, ocean life and dinosaurs.

Additionally, children also enjoy imitating their parents, siblings and friends that care for and walk real pet animals. Thus, pet analogues, such as toy animals, are very popular, again evidenced by the product sales in the toy industry.

Toy animals exist in many physical manifestations, such as soft plush, inflatable vinyl, rubberized foam, flexible vinyl, semi rigid plastic, hard plastic, wood, metal and combinations thereof. Much innovation has been developed to enhance play experience with toy animals to simulate many living characteristics such as walking, running, hopping, vibrating, breathing, talking, eating, urinating, sleeping and numerous sound effects.

One characteristic of toy animals that is popular among children is locomotion. Specifically, toy animals more effectively simulate live animals when they include a form of movement. There have been numerous product versions of "walking animals" that attempt to mimic live animals. Children specifically enjoy toy animals that simulate a pet that is walked on a leash. Toy animals with articulating features that simulate some type of movement such as walking or running originally were mechanical in design. For example, some examples of toy animals that have locomotive characteristics include: child activated pull strings, keys and spring wound coils. Some toy animals would merely require the child to set the toy animal on an inclined plane, and the toy animals would moves, typically with wheels, down the incline.

However over the last 30 years with advancements in electronics many toy animals integrate motorized robotic technology. Therefore, there are two general categories walking toy animals: 1) mechanical versions without electronics; and 2) electronic versions incorporating batteries, motors, sensors, integrated circuits and robotics. Electronic versions of toy animals tend to be expensive, difficult to manufacture, and tend to not replicate accurate animal movement. Mechanical versions may also suffer from being overly complicated, difficult to manufacture, and prone to break when used by children.

A need, therefore, exists for relatively simple mechanical toy animals for individuals, namely children. Moreover, a need exists for toy animals that effectively and accurately mimic animal movement.

In addition, a need exists for toy animals that simulate animal movement that can be utilized by children without being fragile and prone to break. Further, a need exists for toy animals that are utilized by children who wish to emulate adults by taking their toy animals for walks.

And, a need exists for toy animals having internal mechanisms that effectively simulate animal movement so as to create an illusion in users that the toy animal is real. Still further, a need exists for toy animals that may be easily controlled by a user when walking the same on a simulated leash.

SUMMARY OF THE INVENTION

The present invention relates to mechanical toy animals. More specifically, the toy animals of the present invention include internal mechanisms that allow the mechanical toy animals to simulate live animals. The present invention allows children to physically "walk" the toy animal on a leash. Methods of making and using the same are further provided.

To this end, in an embodiment of the present invention, an animal walking toy apparatus that achieves realistic leg movements is provided. The animal walking toy apparatus comprises: a body element configured to appear as an animal, the body element having a main portion and a front right leg, a front left leg, a rear right leg and a rear left leg disposed downwardly from the main portion; a drive mechanism apparatus comprising: a housing comprising a front end, a rear end, a first side and a second side; a wheel disposed in proximity to the front end of the housing, the wheel configured to roll on a rolling surface; a first arm having a first end and a second end, and a midpoint, the first arm disposed in proximity to the front end of the housing, the first arm pivotally connected to the housing at about the midpoint of the first arm, the first end of the first arm connected to the front right leg of the body element and the second end of the first arm connected to the front left leg of the body element; a second arm having a first end and a second end, and a midpoint, the second arm disposed in proximity to the rear end of the housing, the second arm pivotally connected to the housing at about the midpoint of the second arm, the first end of the second arm connected to the rear right leg of the body element and the second end of the second arm connected to the rear left leg of the body element; and a linkage between the wheel and at least one of the first and second arms, wherein the linkage translates the rotational motion of the wheel to back and forth substantially linear movement of the at least one of the first and second arms.

In an embodiment, the linkage moves the first end of the at least one of the first and second arms forwardly and at the same time moves the second end of the at least one of the first and second arms rearwardly.

In an embodiment, the linkage moves the first end of the at least one of the first and second arms rearwardly and at the same time moves the second end of the at least one of the first and second arms rearwardly.

In an embodiment, the linkage translates the rotational motion of the wheel to back and forth substantially linear movement of both the first and second arms.

In an embodiment, the linkage moves, in a synchronized manner, the first end of the first arm forwardly, the second end of the first arm rearwardly, the second end of the second arm forwardly, and the first end of the second arm rearwardly.

In an embodiment, the wheel comprises a crank axle, and the linkage comprises: a rocker disposed in about a midsection of the housing, the rocker having an extended element on a side thereof disposed in a slot of the housing, wherein the extended element moves within the slot of the housing; a main link disposed between the crank axle and the rocker; a first link disposed between the rocker and the first arm in proximity to the first side of the housing; and a second link disposed between the rocker and the second arm in proximity to the second side of the housing, wherein movement of the wheel causes the crank axle to revolve, causing the main link to move the rocker, causing the first link to move the first end of the first arm in a first direction and the second link to move the second end of the second arm in the first direction.

In an embodiment, the rocker comprises a pin that is attached to a side of the housing, wherein the rocker is rotatable about the pin, and further wherein the main link causes the rocker to rotate around the pin, wherein movement of the rocker causes the extended element to move within the slot of the housing, causing the first and second links to move.

In an embodiment, movement of the wheel sequentially moves the first end of the first arm and the second end of the second arm in the first direction, and the first end of the first and the second end of the second arm to move in a second direction, wherein the first direction and the second direction are opposite from each other.

In an embodiment, the animal walking toy apparatus further comprises: a second wheel adjacent the first wheel.

In an embodiment, the wheel sits between the front right leg and the front left leg.

In an embodiment, the wheel comprises a traction element for engaging the wheel on a surface.

In an embodiment, the animal walking toy apparatus further comprises: a rigid or semi-rigid elongated leash element having a first end and a second end, the first end connected to the top of the body element and a second end having a handle.

In an embodiment, the housing comprises a bracket extending through a top of the body element, wherein the elongated leash element is connected to the bracket.

In an embodiment, the animal walking toy apparatus further comprises: stiffeners located in the legs of the body element.

In an embodiment, the legs are disposed a distance above the rolling surface.

In an embodiment, each of the legs comprises a contact element configured to contact the rolling surface.

In an embodiment, the contact element is selected from the group consisting of a plastic skid, a wheel, and a rolling ball.

In an embodiment, the body element is removable from the housing so that a second body element may be disposed on the housing.

In an embodiment, the animal walking toy apparatus further comprises: a sound module.

In an embodiment, the animal walking toy apparatus further comprises: a self-propelling element for propelling the toy animal apparatus forwardly or rearwardly.

It is, therefore, an advantage and objective of the present invention to provide relatively simple, mechanical toy animals for individuals, namely children.

Moreover, it is an advantage and objective of the present invention to provide toy animals that effectively and accurately mimic animal movement.

In addition, it is an advantage and objective of the present invention to provide toy animals that simulate animal movement that can be utilized by children without being fragile and prone to break.

Further, it is an advantage and objective of the present invention to provide toy animals that are utilized by children who wish to emulate adults by taking their toy animals for walks.

And, it is an advantage and objective of the present invention to provide toy animals having internal mechanisms that effectively simulate animal movement so as to create an illusion in users that the toy animal is real.

Still further, it is an advantage and objective of the present invention to provide toy animals that may be easily controlled by a user when walking the same on a simulated leash.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to mechanical toy animals. More specifically, the toy animals of the present invention include internal mechanisms that allow the mechanical toy animals to simulate live animals. The present invention allows children to physically "walk" the toy animal on a leash. Methods of making and using the same are further provided.

Figure 1:
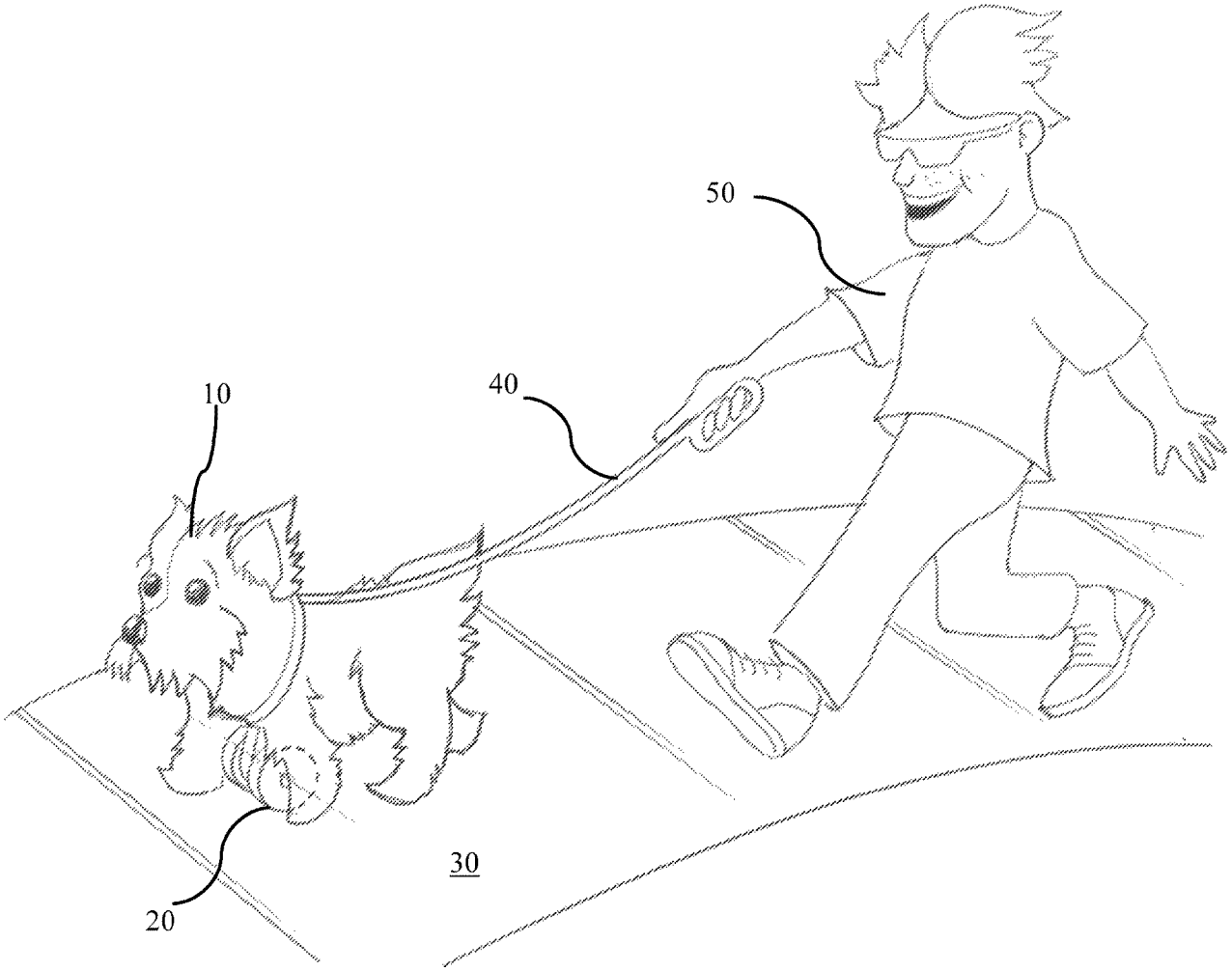
FIG. 1 illustrates a perspective view of a toy animal having simulated walking motion being utilized by a child in an embodiment of the present invention.
Figure 2:
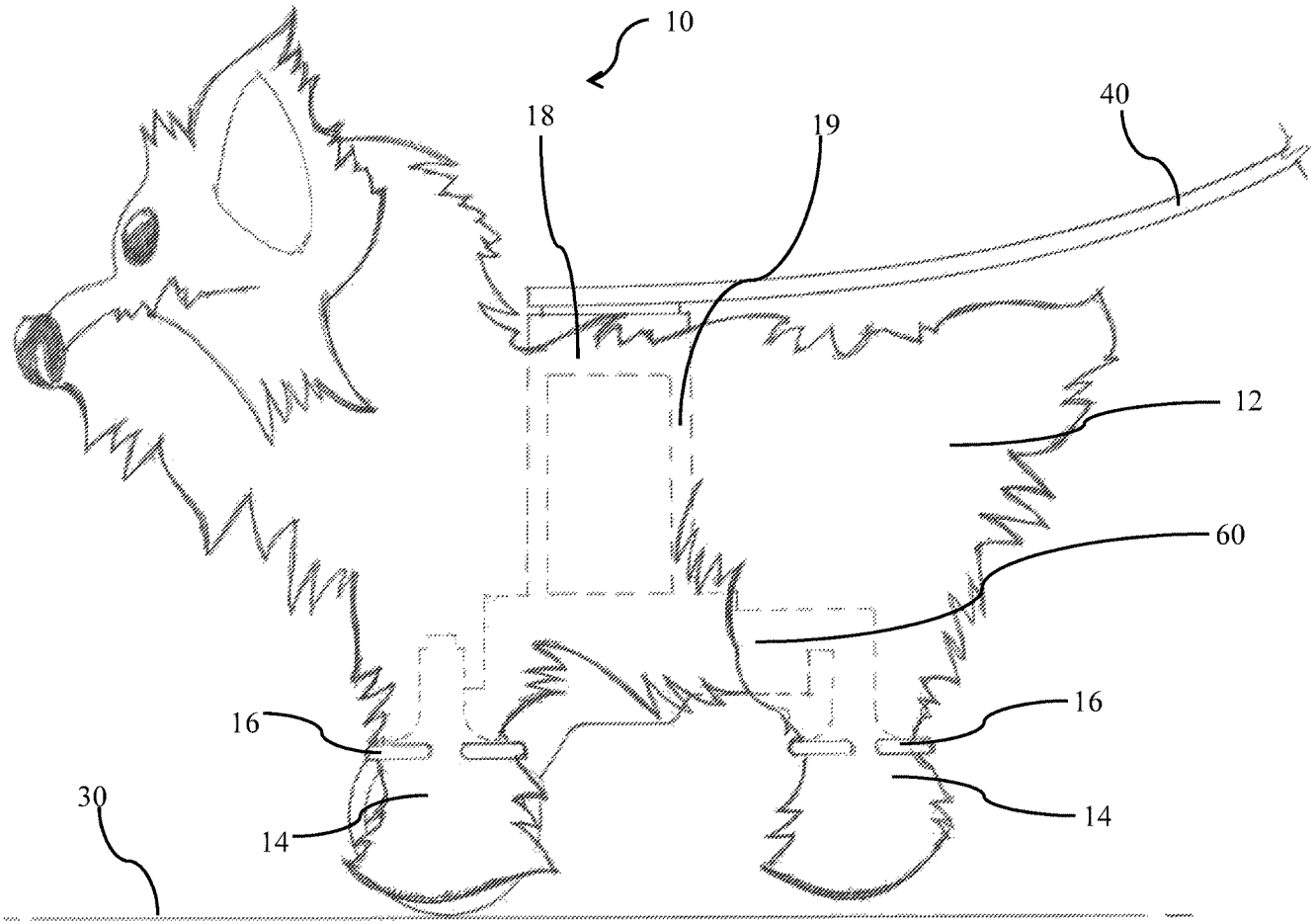
FIG. 2 illustrates a side view of a toy animal in an embodiment of the present invention.

Now referring to the figures, wherein like numerals refer to like parts, FIG. 1 illustrates a perspective view of a toy animal 10 having an internal drive mechanism assembly 60 (as illustrated in FIG. 2) that creates a simulated walking motion in the toy animal 10. The internal drive mechanism assembly 60 generally translates rotating motion of the toys wheels 20 as the wheels 20 are driven along a surface 30 into simulated animal walking movements in the toy animal 10. The toy animal 10 is driven via a "leash" linkage 40 attached to the toy animal's top or back. Preferably, the leash linkage 40 is in the shape and appearance of a leash that may be held by the user 50 thereof, allowing the user 50 to push and/or pull the toy animal 10 as it traverses over the surface 30.

Figure 3:
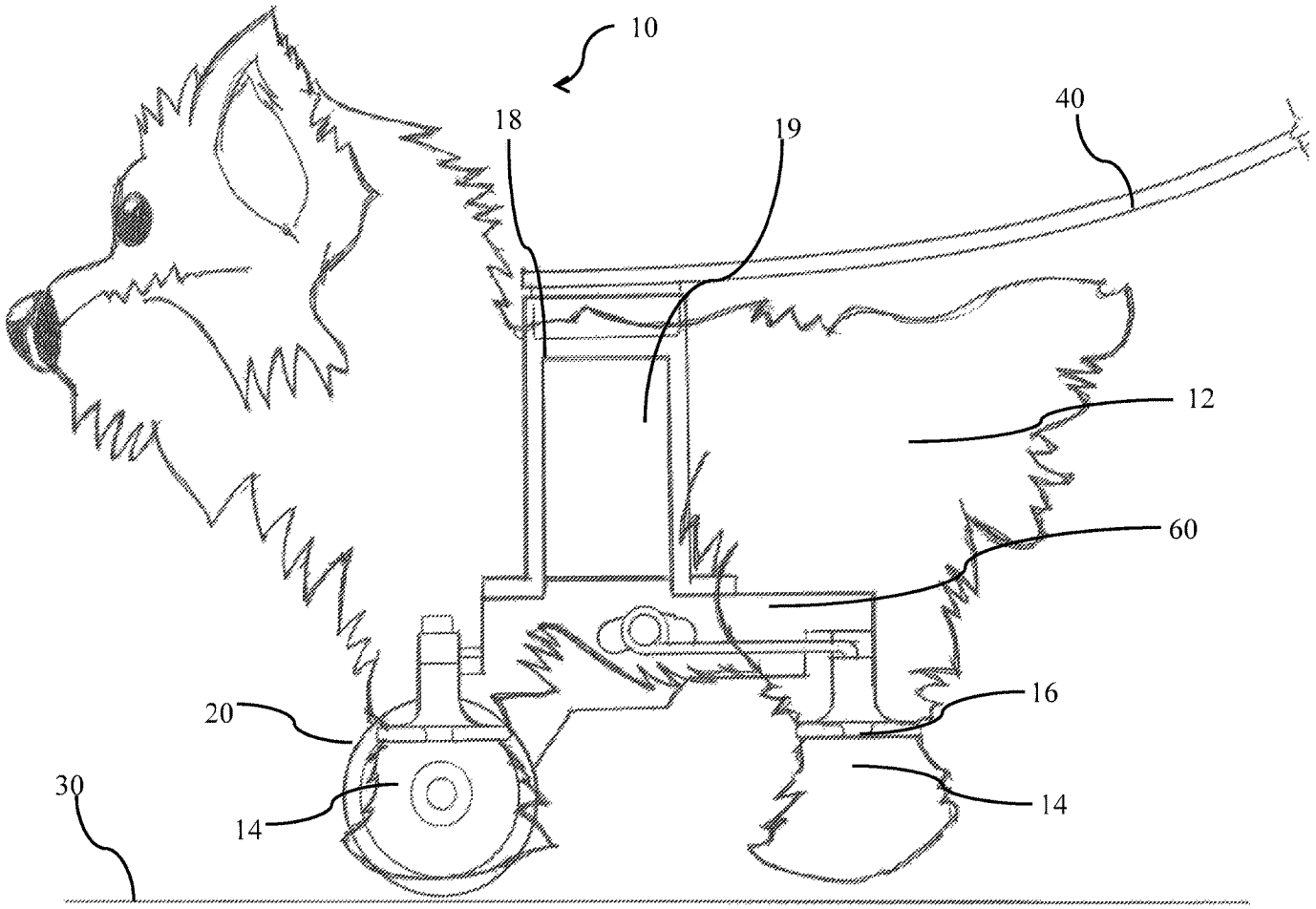
FIG. 3 illustrates a cut-away side-view of a toy animal in an embodiment of the present invention.
Figure 4:
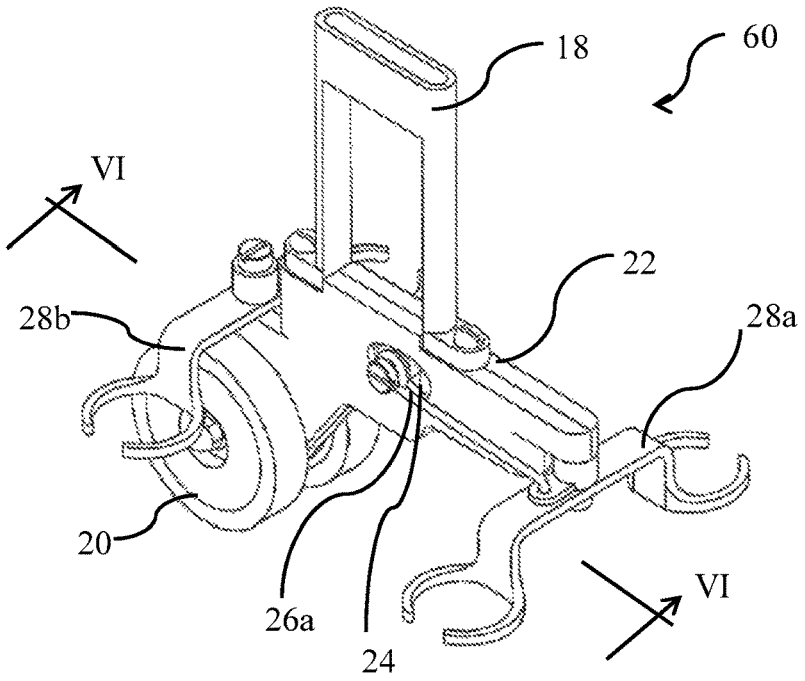
FIG. 4 illustrates a perspective view of an internal mechanism of a toy animal for simulating movement of the toy animal in an embodiment of the present invention.
Figure 5:
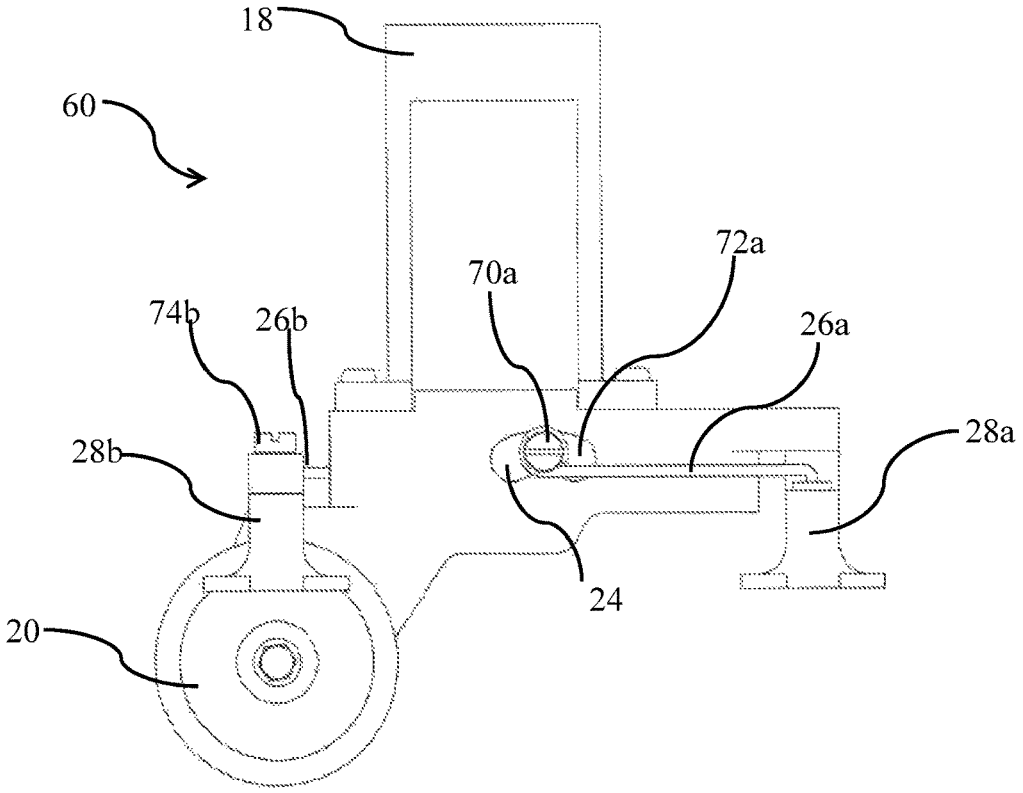
FIG. 5 illustrates a side view of an internal mechanism of a toy animal for simulating movement of the toy animal in an embodiment of the present invention.
Figure 6:
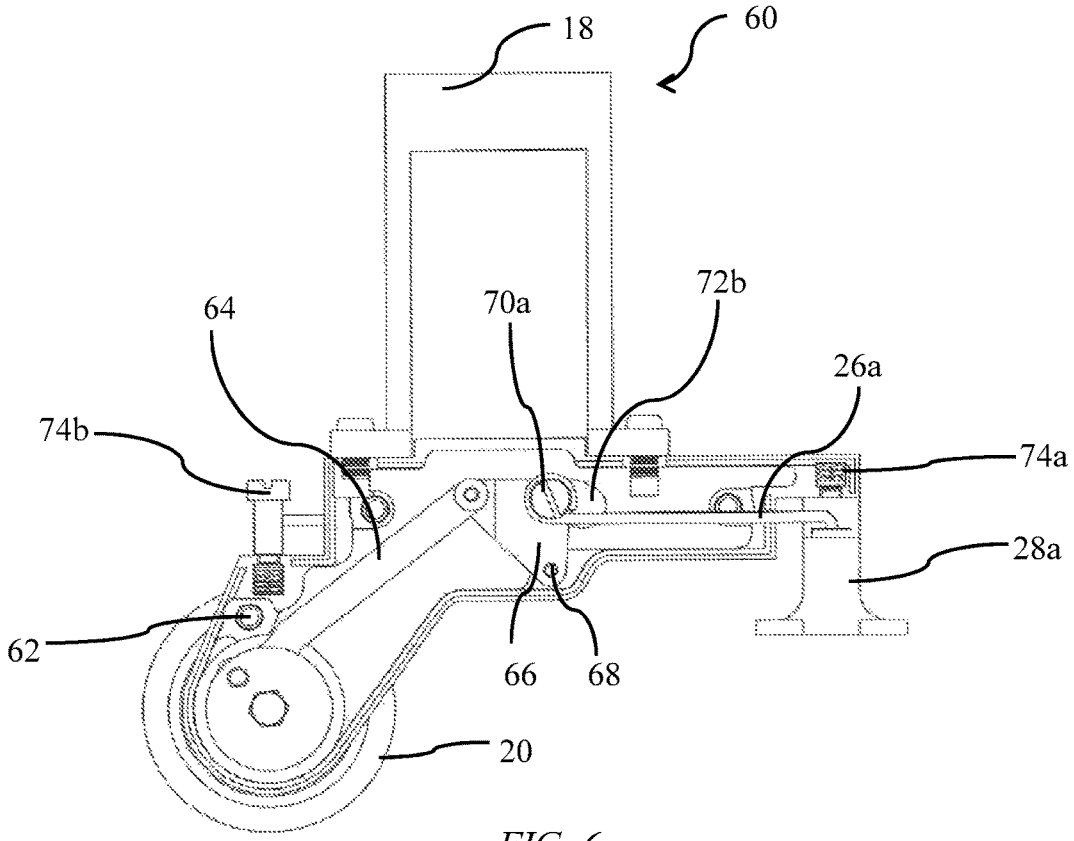
FIG. 6 illustrates a cross-sectional view of an internal mechanism of a toy animal for simulating movement of the toy animal in an embodiment of the present invention.
Figure 7:
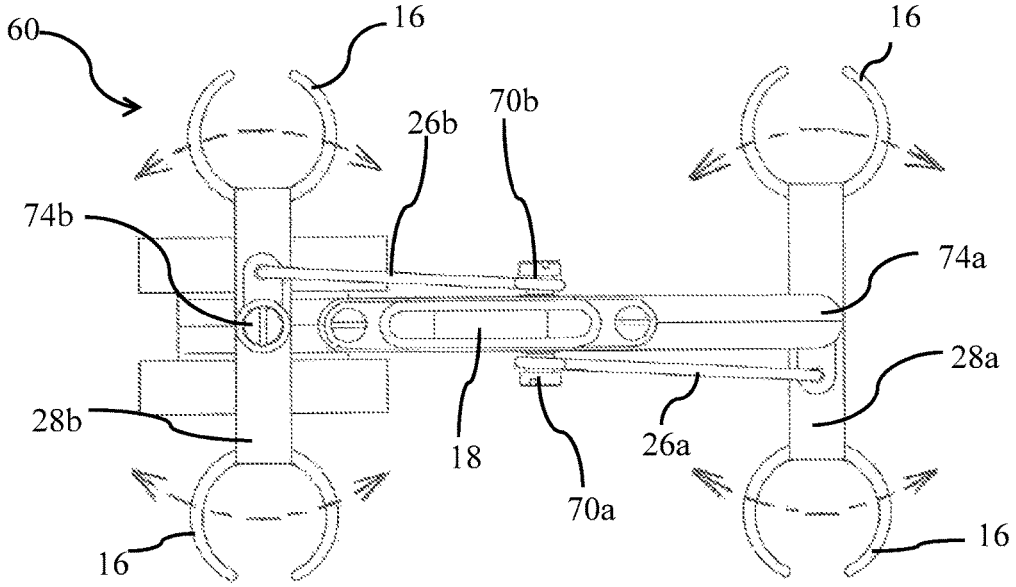
FIG. 7 illustrates a top plan view of an internal mechanism of a toy animal for simulating movement of the toy animal in an embodiment of the present invention.

The present invention is intended to be used as a toy for a child to simply pick up the leash linkage 40 by a handle thereof and move the toy animal 10 in any direction. As the toy animal 10 moves, it will appear to be walking on its own behalf, achieved through the wheels 20 and the internal drive mechanism assembly 60 (as illustrated in FIGS. 2 and 3) while the user 50 follows behind. Ultimately, the parts of the toy animal 10, the wheels 20, the internal drive mechanism assembly 60 (as described in more detail below), and the linkage 40 may be made from durable and resilient materials to ensure smooth and durable operation.

In an embodiment, the toy animal 10 may be in the shape and appearance of a furry puppy dog (as illustrated in FIGS. 1-3) that can be walked indoors or outdoors, while simulating leg and/or body movements to appear as if the toy animal 10 is moving on its own. However, it should be noted that the toy animal 10 may be in the guise of any animal, such as an alligator, crocodile, lizard, turtle, porcupine, cat or other like animal, and the present invention should not be limited as disclosed herein.

FIG. 2 illustrates a side view of the toy animal 10 having a body 12 and a plurality of legs 14. The legs 14 may be interconnected to the internal drive mechanism assembly 60 via clips 16 that may move the legs 14 as internal drive mechanism assembly 60 moves, as described below. The internal drive mechanism assembly 60 may further be connected to leash linkage 40 through a bracket 18 that may extend via a frame 19 extending from the internal drive mechanism assembly, and further extending from a back or top of the toy animal 10.

FIG. 3 illustrates a cut-away view of the internal drive mechanism assembly 60 in an embodiment of the present invention. The internal drive mechanism assembly 60 may include the wheels 20 positioned between the front two legs of the toy animal 10, and through one or more linkages within internal drive mechanism assembly 60, may translate rotational motion of the wheels 20 as they roll along the surface 30 to linear motion, thereby moving the legs 14 back and forth in synchronization to simulate the walking motion of the toy animal 10.

The internal drive mechanism assembly 60 may be partially inserted into the body 12 of the toy animal 10 from an underside thereof, but allowing the bracket 18 to extend through the body 12 to a back or top of the body 12 for attachment to the leash linkage 40. The internal drive mechanism assembly 60 may be mostly hidden due to the body 12 of the toy animal 10, and only a small portion of the wheels 20 may be visible between the front legs. When assembled and ready for use, the legs 14 may be slightly elevated from the surface 30 so as not to create friction or drag. Preferably, the legs 14 may be elevated about 0.25 inches above the surface 30, but the invention should not be so limited.

Internal Drive Mechanism Assembly

The internal drive mechanism assembly 60, as shown in more detail in FIGS. 4-7, may comprise the wheels 20 that may be located on each side of a main housing 22 near a front portion of the main housing 22 for stability, control and ease of maneuverability of the toy animal 10 by a user thereof. The wheels 20 may be sized as wide as possible for stability, but still maintain their concealed location between the two front legs of the toy animal 10. Moreover, the position of the wheels 20 may minimize over-rotation of the toy animal apparatus and maintain level position of the toy animal 10 when force is transferred by a user in use thereof, as disclosed below. The wheels may have high tactile tread elements disposed thereon to provide ample traction as the wheels 20 roll over the surface 30. One or more additional wheels (not shown) may be disposed at or near the rear portion of the main housing 22 to provide added stability to ensure that the toy animal 10 does not tip over or otherwise become unbalanced.

As the wheels roll, rotational movement of the wheels 20 may translate to linear movement via an internal rocker 24 that may be interconnected through arm linkages 26*a*, 26*b* to pivoting arms 28*a*, 28*b*. The pivoting arms 28*a*, 28*b* may have the clips 16 thereon for connecting the arms 28*a*, 28*b* to the respective legs 14 of the toy animal 10. Although the clips 16 are shown in the figures herein, it should be noted that the arms 28*a*, 28*b* of the internal drive mechanism assembly 60 may be connected or otherwise attached to the legs 14 of the toy animal 10 via any means apparent to one of ordinary skill in the arm, including the clips as shown, snaps, hook and loop fasteners, pin and hoop fasteners, thread, glue, or other like attachment means. In a preferred embodiment, the legs of the toy animal 10 may be easily separable from the internal drive mechanism assembly 60 so that the body 12 of the toy animal 10 may be easily removed to access the internal drive mechanism apparatus 60 and/or for swapping the body 12 for a body of a different animal. When removed, the internal drive mechanism apparatus 60 may include protective sleeves and/or covers to ensure that users are not hurt by the internal drive mechanism apparatus 60, and to ensure that dirt does not enter the internal drive mechanism apparatus 60.

The translation of the rotational movement of the wheels 20 into linear motion that may control the backward and forward movement of the legs 14 of the toy animal 10 may be achieved in a plurality of ways. In a preferred embodiment, illustrated in FIGS. 6 and 7, the wheels 20 may include a crank axle 62 connected to a main linkage 64 on a first end of the main linkage 64, and to a rocker 66 on a second end thereof. The rocker 66 may pivot on a pin 68 attached to the housing 22, thereby causing a pair of bolts 70*a*, 70*b* to arcuately move through a pair of paths 72*a*, 72*b* on opposite sides of the housing 22.

The arm linkages 26*a*, 26*b* may thus move alternatively forwardly and rearwardly due to the movement of the rocker 66 and bolts 70*a*, 70*b*. As the arm linkages 26*a*, 26*b* move forwardly and rearwardly, the arms 28*a*, 28*b* may move accordingly. The arms 28*a*, 28*b* may be pivotally connecting at midpoints thereof via rotating pins 74*a*, 74*b*. Arm linkage 26*a* may be connected on one end to the bolt 70*a* of the rocker 66 and at another end thereof to one side of the arm 28*a* one a first side and toward the rear of the housing 22. Likewise, the arm linkage 26*b* may be connected on one end thereof to the bolt 70*b* of the rocker 66 and at another end thereof to one side of the arm 28*b* on a second side and toward the front of the housing 22. Thus, as the bolts 70*a*, 70*b* move rearwardly in paths 72*a*, 72*b*, the one side of the arm 28*a* that is connected to the arm linkage 26*a* may also move rearwardly on the first side of the housing 22. At the same time, the one side of the arm 28*b* that is connected to the arm linkage 26*b* may also move rearwardly on the second side of the housing 22. As the arms 28*a*, 28*b* move rearwardly, the rotating pins 74*a*, 74*b* pivot freely, causing the opposite sides of the arms 28*a*, 28*b* to move in the opposite direction, in this case forwardly.

Thus, as the wheels complete a 360 degree turn when in motion, the crank axle may further complete a 360 degree turn completing a full cycle. The legs of the toy animal 10 may also complete a full cycle of moving forward and rearwardly. Thus, the front right leg of the toy animal 10 and the rear left leg of the toy animal 10 may synchronously move forward while the front left leg and the rear right leg move rearwardly. Likewise, the front right leg of the toy animal 10 and the rear left leg may synchronously move rearwardly while the front left leg and the rear right leg move forwardly.

The positions of connection points of the first and second linkages 26*a*, 26*b* and/or the main linkage 64 may be optimized to provide the most realistic movement of the toy animal's legs 14, and should be well within the capability of one having ordinary skill in the present art. For example, a toy animal that may look like a lizard may have a different leg motion that a toy animal that looks like a dog, and the internal parts of the internal drive mechanism assembly 60 may be adjusted accordingly.

Of course, it should be noted that because the toy animal 10 is meant to be utilized by children, protections may be built in, such as protective covers and the like to ensure that body parts of the users do not get pinched or damaged due to the moving parts of the internal drive mechanism 60 or any other part of the toy animal 10.

Figure 8A:
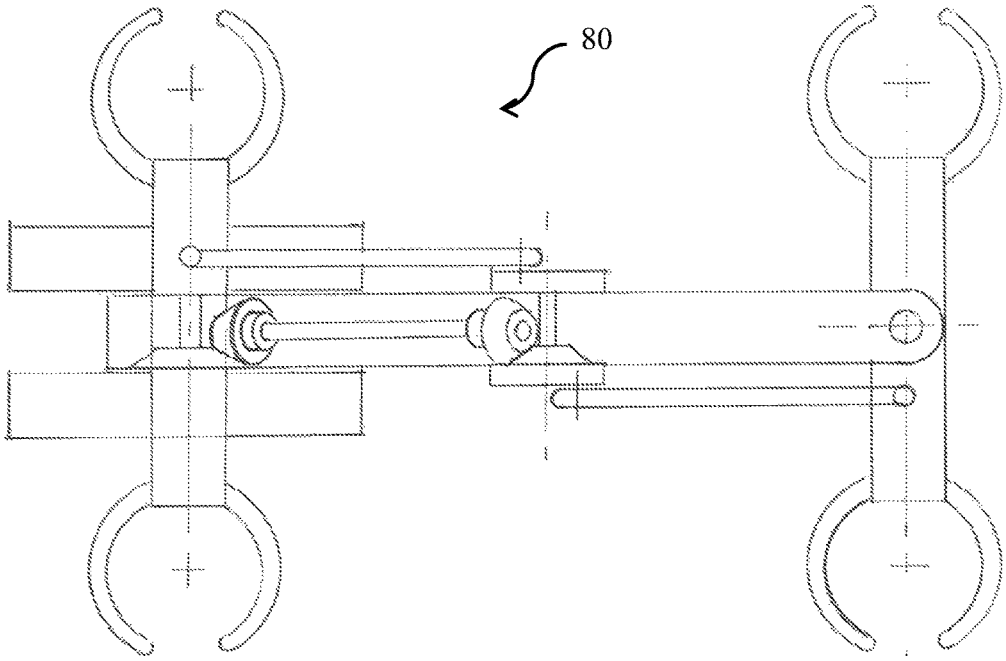
FIGS. 8A and 8B illustrate a top plan view and a side view, respectively, of an internal mechanism of a toy animal for simulating movement of the toy animal in an alternate embodiment of the present invention.
Figure 8B:
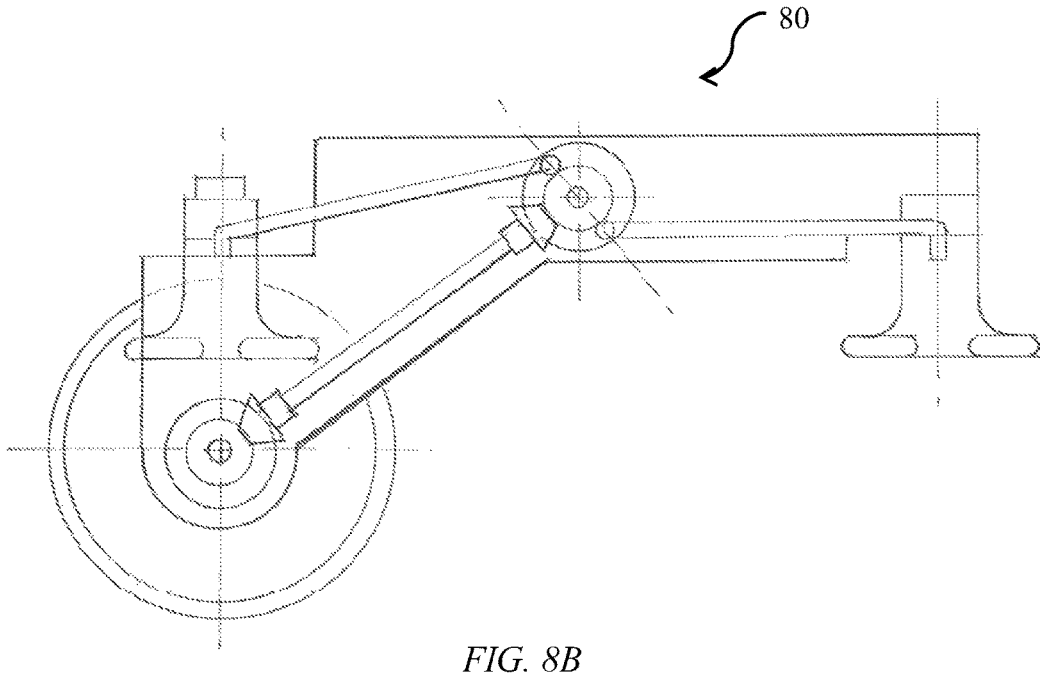
Figure 9A:
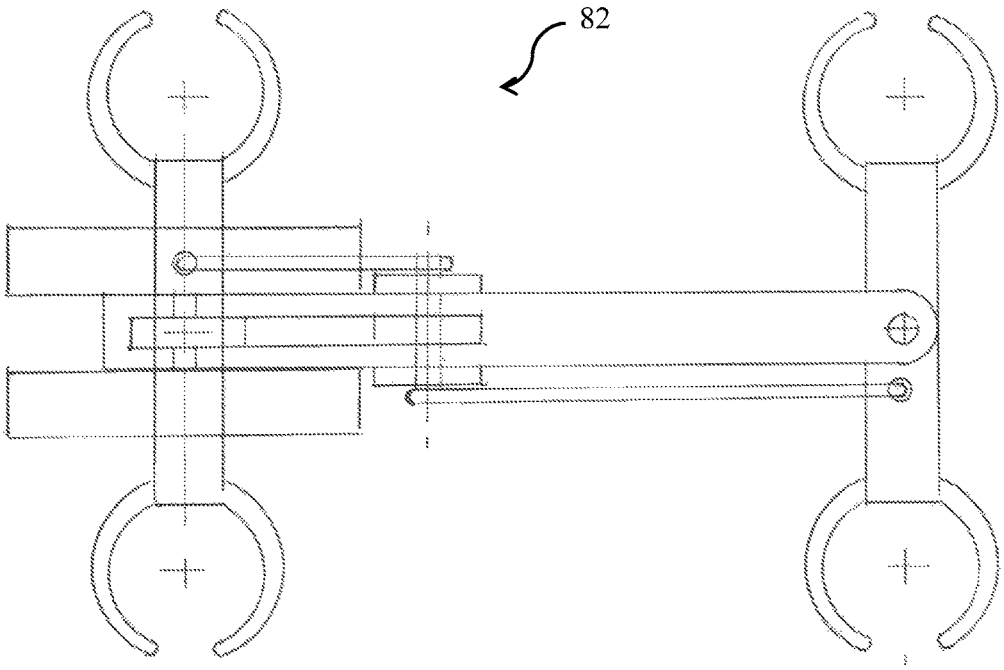
FIGS. 9A and 9B illustrate a top plan view and a side view, respectively, of an internal mechanism of a toy animal for simulating movement of the toy animal in a further alternate embodiment of the present invention.
Figure 9B:
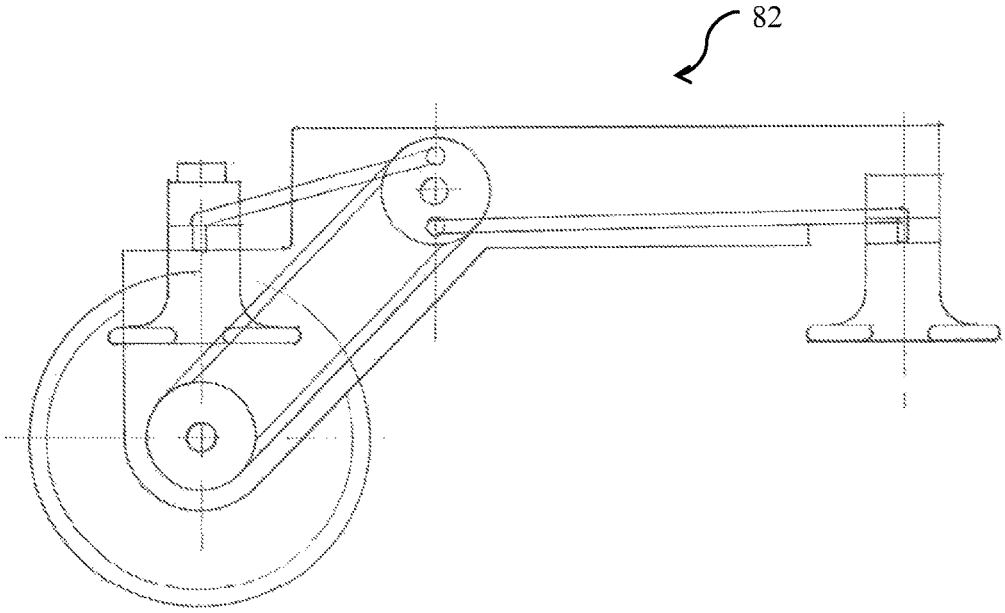
Figure 10A:
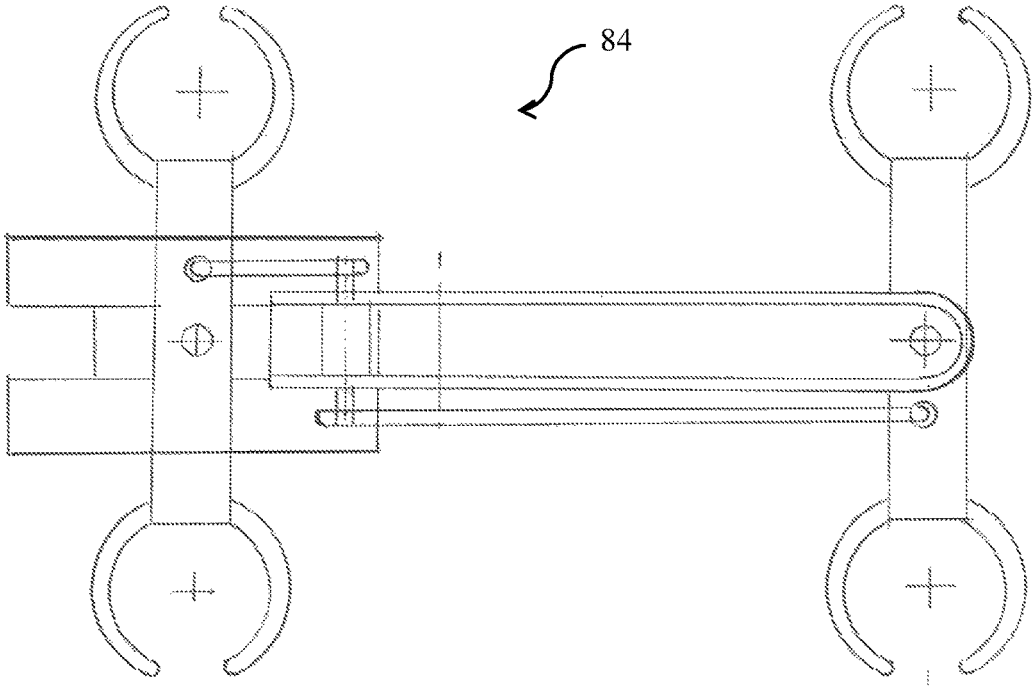
FIGS. 10A and 10B illustrate a top plan view and a side view, respectively, of an internal mechanism of a toy animal for simulating movement of the toy animal in yet another alternate embodiment of the present invention.
Figure 10B:
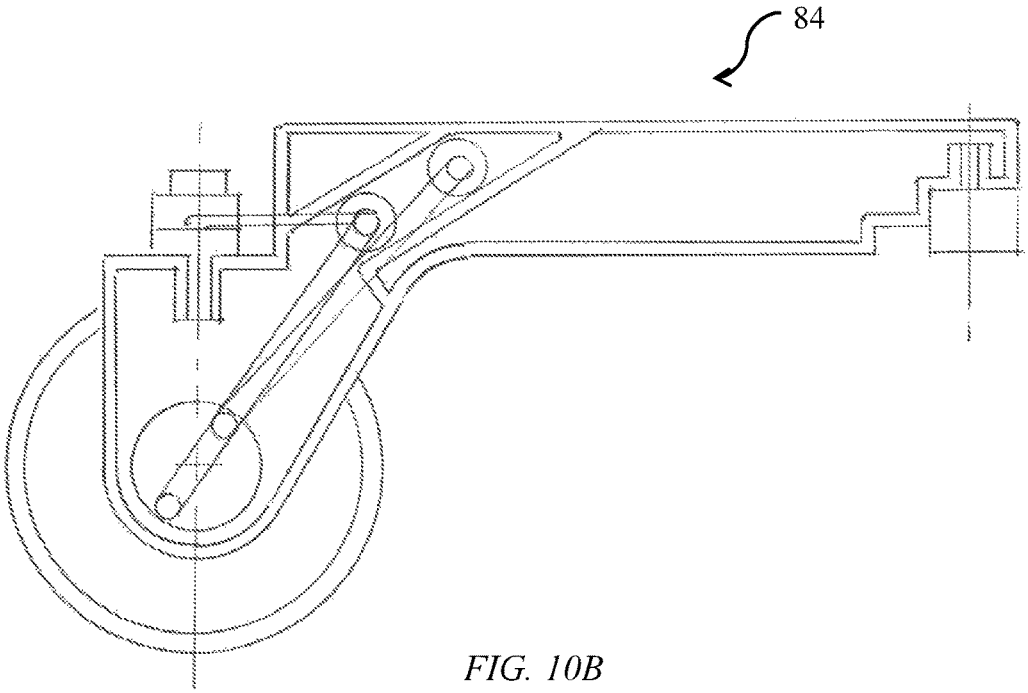
Figure 11A:
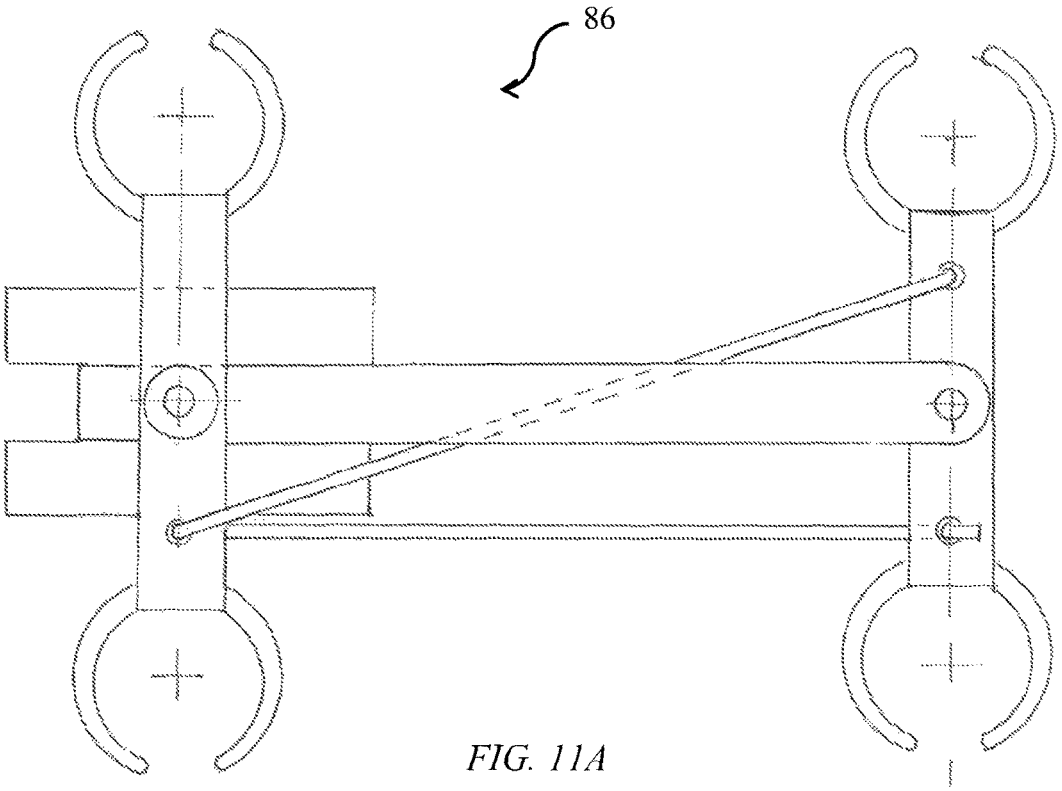
FIGS. 11A and 11B illustrate a top plan view and a side view, respectively, of an internal mechanism of a toy animal for simulating movement of the toy animal in a still further alternate embodiment of the present invention.
Figure 11B:
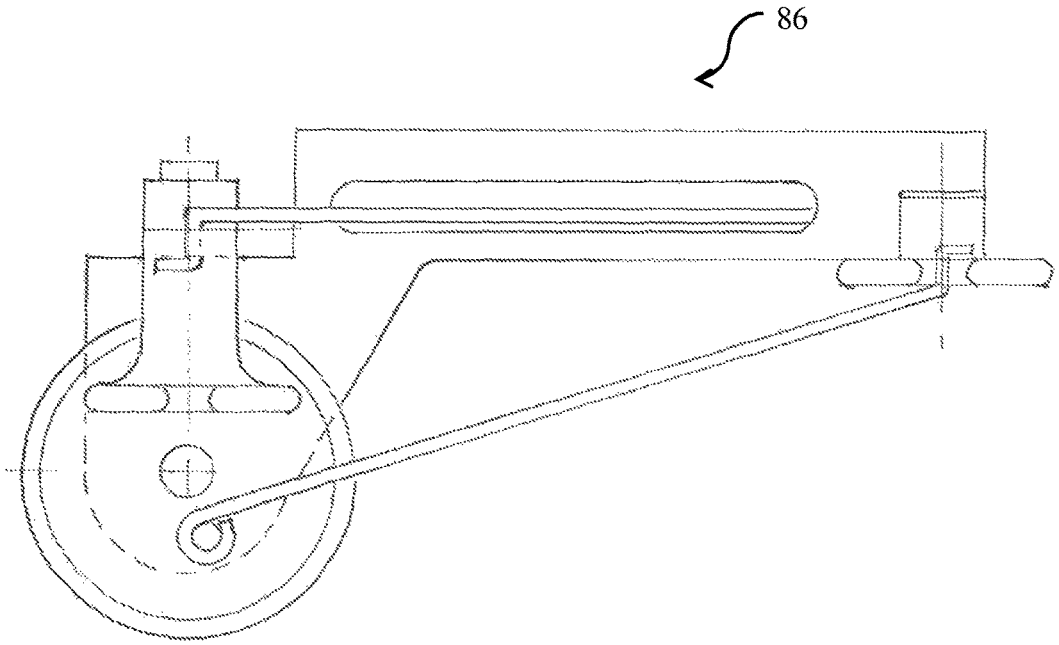

Moreover, although the present invention describes a preferable mechanism to translate rotational movement of the wheels into linear rearward and forward movement of the legs thereof, it should be noted that other mechanisms may be utilized to do the same, and the present invention should not be limited as described herein. For example, the crank axle 62, primary linkage 64 and rocker 66 may be replaced with a bevel gear apparatus 80, as shown in FIGS. 8A-8B. A chain drive apparatus 82 may also be utilized, as shown in FIGS. 9A-9B. Moreover, an angled slide roller apparatus 84 may also be utilized, as shown in FIGS. 10A-10B. In addition, a direct drive offset axle system 86 may be utilized, as illustrated in FIGS. 11A-11B.

Figure 12:
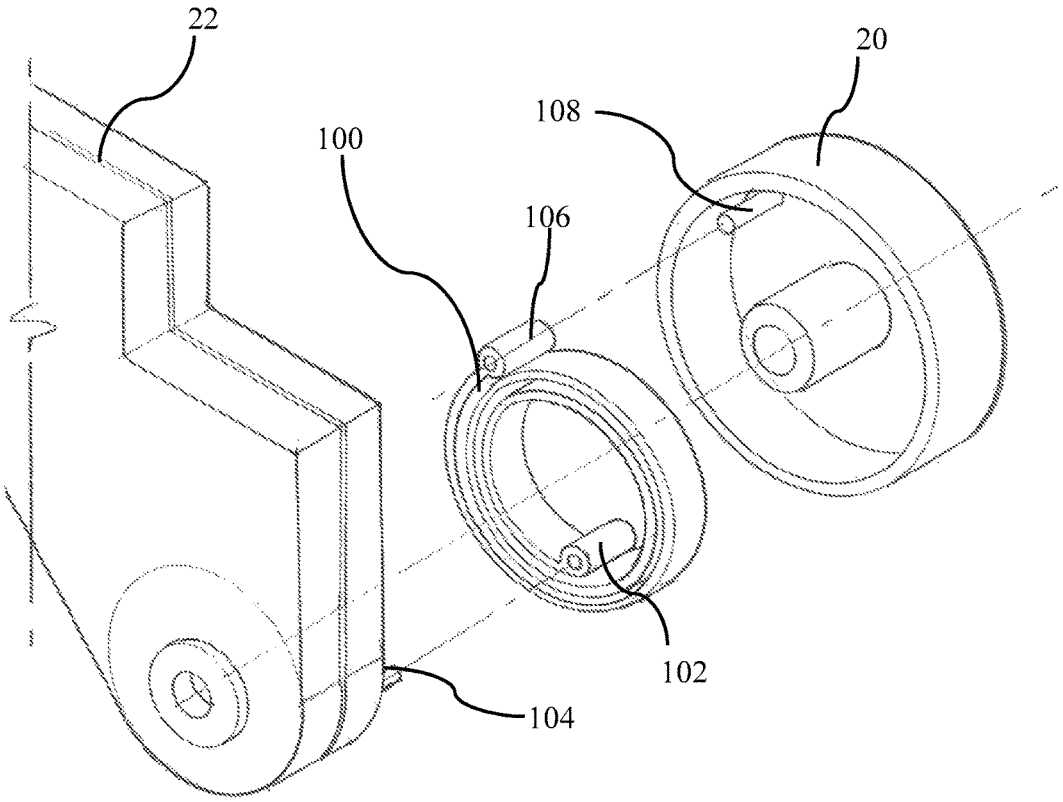
FIG. 12 illustrates a coil spring element incorporated into a wheel of an internal drive mechanism assembly of a toy animal in an embodiment of the present invention.

In an alternate embodiment of the present invention, illustrated in FIG. 12, an exploded view of a coiled spring element 100 is provided. The coiled spring element 100 may be incorporated within one or both of the wheels 20 to allow the toy animal apparatus 10 to be self-propelled by winding the coiled spring element 100. Specifically, a first end 102 of the coiled spring element 100 may be connected to a first post 104 on the housing 22, and a second end 106 of the coiled spring element 100 may be connected to second post 108 on the wheel 20. The coiled spring element 100 may be disposed in the wheel 20 in such a manner that moving the wheel in a direction causes the coiled spring element 100 to wind, whereby releasing the wheel 20 releases the coiled spring element 100, causing the wheel to propel. Of course, the coiled spring element 100 is one of a plurality of ways that the toy animal apparatus 10 may be self-propelled, as other ways of causing the toy animal apparatus 10 to move may be utilized without limiting the present invention. Indeed, other types of springs, bands, motors, or other like elements may be utilized to propel the toy animal 10 forwardly and/or rearwardly, causing the legs of the toy animal to move in a realistic manner, as described herein.

Toy Animal Body

The toy animal 10 may be of any animal theme or character style, and may be constructed from any material and process, including, preferably, sewn plush fabric with soft internal stuffing to maintain its general shape. Alternatively, the toy animal 10 may be made from molded plastic, including slush molded, drape molded, cast molded, rotary molded, blow molded, injection molded and vacuum formed. The body may further be made from vinyl, rubberized foam, wood or any other suitable material and processes.

The toy animal 10 may specifically include articulating legs that allow the legs to translate forwardly and rearwardly, and a slot in its top or back to allow the bracket 18 to extend therethrough for connection to the linkage 40. The internal compartment that may hold the internal drive mechanism assembly 60 may be separated from the internal stuffing of the toy animal, via a sleeve, for example, to separate the internal drive mechanism assembly 60 from the stuffing. Therefore, the stuffing may be prevented from interfering with the internal drive mechanism assembly 60, and further prevent the stuffing from falling out while in use. In an embodiment, the toy animal body may be easily removed from the internal drive mechanism assembly 60 and the linkage 40 so that a different toy animal body may be disposed thereon, such as if a user wishes to swap the toy animal body shape and appearance.

The legs 14 of the toy animal 10 may further contain leg stiffeners (not shown) that may accentuate movement of the legs 14, stabilize and maintain a level body and aid in preventing the legs from touching the surface 30. Alternatively, the legs may incorporate plastic skis or rollers (not shown) on an underside thereof that may contact the surface 30, so as to reduce friction and not gather unwanted dirt or dust.

The toy animal 10 may further have a sound module disposed therein for creating sound effects, such as barking or talking. Further, the sound module may be connected to a motion sensor-activated control box with an integrated battery, speaker and programmed IC so that the toy animal 10 may play noises. A push button or remote control may also be implemented for allowing a user to control the sounds.

Leash Linkage

Figure 13:
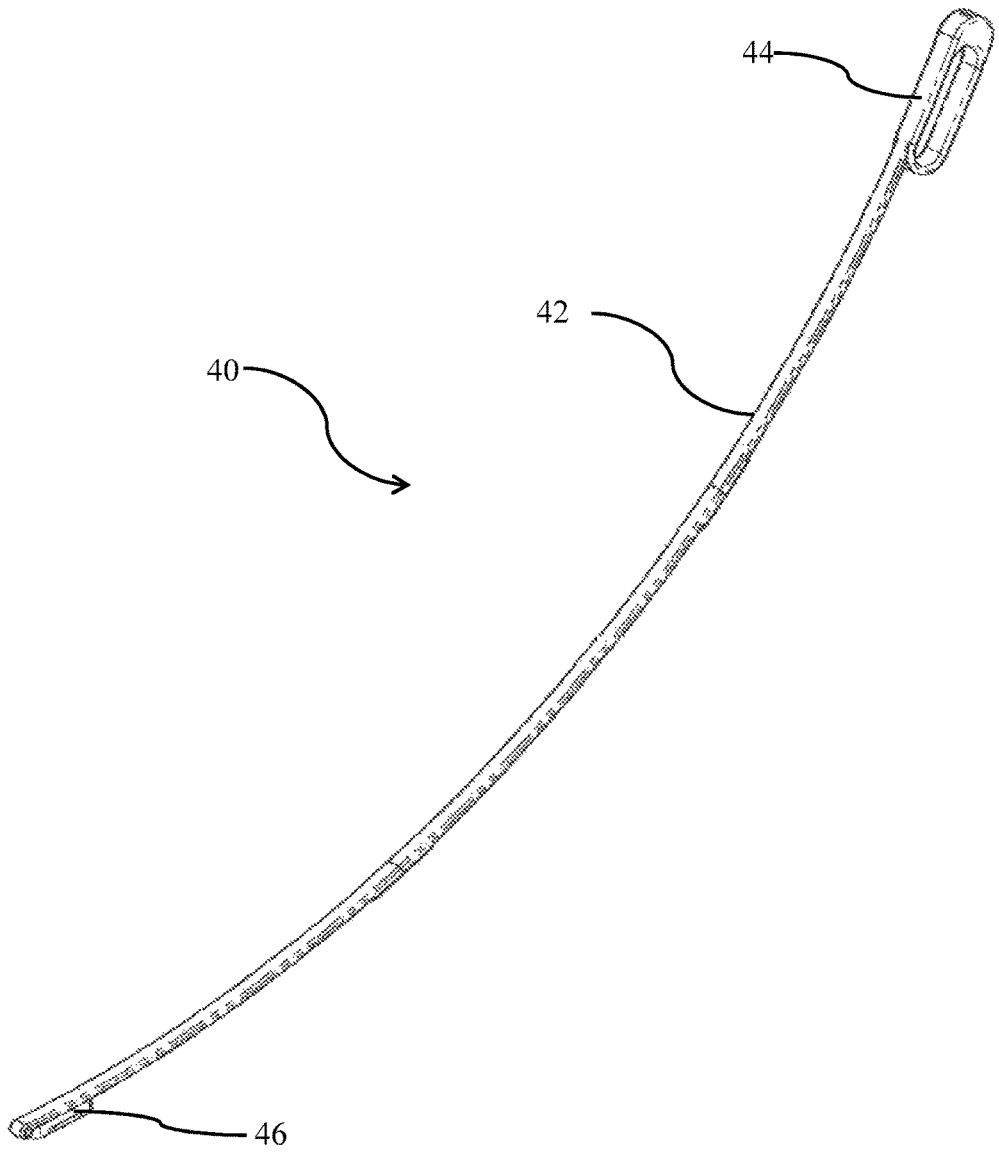
FIG. 13 illustrates a leash linkage element for a toy animal in an embodiment of the present invention.
Figure 14:
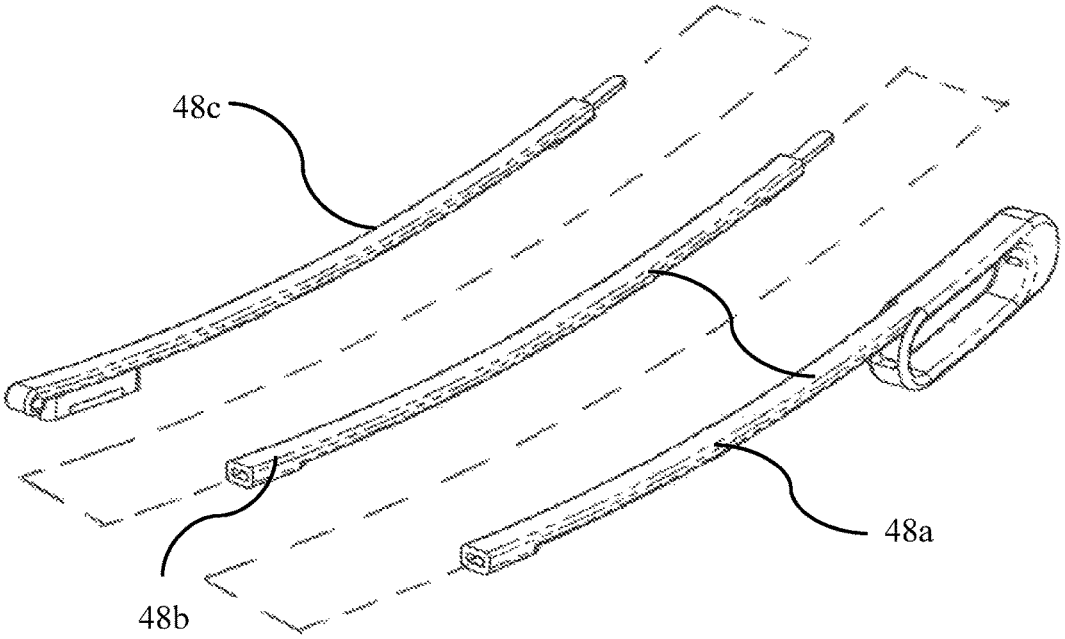
FIG. 14 illustrates a leash linkage element having separable components in an embodiment of the present invention.
Figure 16:
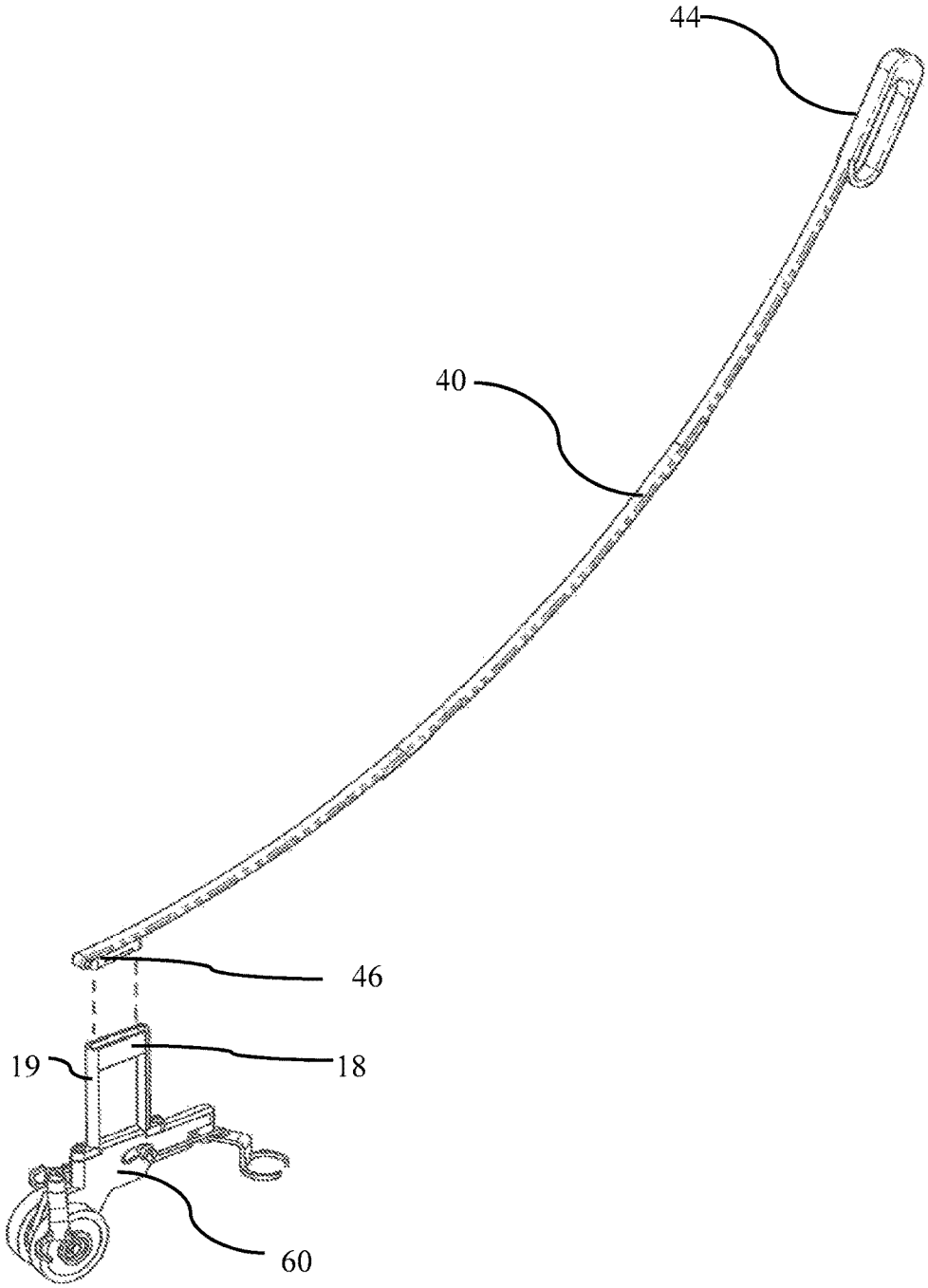
FIG. 16 illustrates a leash linkage element connectable to an internal drive mechanism for a toy animal in an embodiment of the present invention.

The leash linkage 40 may be a rigid or semi-rigid extended element that may be a single piece or may be assembled from a plurality of pieces for ease of transportability, shipping and storage. The rigid or semi-rigid nature of the leash linkage 40 may allow a user to control the force applied to the toy animal 10 by simply holding the leash linkage 40. FIG. 13 illustrates a fully extended leash linkage 40 having main body 42, a handle 44 and a bracket connection element 46. FIG. 14 illustrates leash linkage 40 that may be made from a plurality of smaller elements 48*a*, 48*b*, 48*c* that may be attached, clipped, or otherwise connected together to form the fully extended leash linkage 40, as shown in FIG. 13. The leash linkage 40 may include the handle 44 for comfort and control, and further may include the bracket connection element 46 for interconnecting the leash linkage 40 to the bracket 18 of the toy animal, as illustrated in FIG. 16.

Figure 15:
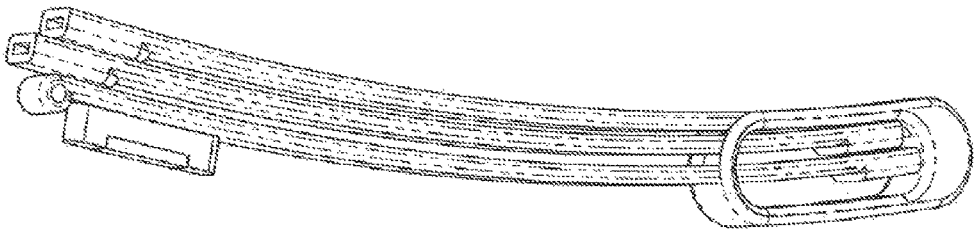
FIG. 15 illustrates a nested arrangement of separable components of a leash linkage element in an embodiment of the present invention.

The leash linkage 40 may be shipped and/or stored in a reduced or collapsed configuration, and may be nested together so that individual smaller elements 48*a*, 48*b*, 48*c* are not misplaced or lost, as illustrated in FIG. 15.

The leash linkage 40 may include various features, including telescoping elements, pivoting elements, and other like features that allow the leash to changes it length, or that allows the leash angle in relation to the toy animal 10 to be changed, so as to accommodate different sized users. Moreover, the leash linkage 40 may have overlapping telescoping pieces that may be adjustable via ratchet interlock, friction slide, or multiple standing post/hole interlock options for different height users.

A sound module and/or sound module controller may be integrated into the leash linkage 40, preferably on the handle 44. Specifically, a speaker may be contained in the handle so that the noises that may electronically emanate from the toy animal 10 may be more easily heard by a user. In addition, one or more buttons or other activating elements may be incorporated into the handle to allow a user to control various aspects of the toy animal, such as a sound module incorporated therein.

The leash linkage 40 may further allow a user to add or integrate elements that may be useful for identification or for other reasons. For example, decorative elements, letters, numbers or other like elements may be provided that may be added to the leash linkage 40. Specifically, a child may wish to name his or her toy animal, and letters may be provided and added to the leash linkage 40 to personalize the same. Moreover, other elements, including collars, bandanas, animal clothing, or other like elements may be utilized to personalize the toy animal for a child user.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An animal walking toy apparatus that achieves realistic leg movements, comprising:

a body element configured to appear as an animal, the body element having a main portion and a front right leg, a front left leg, a rear right leg and a rear left leg disposed downwardly from the main portion;

a drive mechanism apparatus comprising:

a housing comprising a front end, a rear end, a first side and a second side;

a first wheel disposed in proximity to the front end of the housing, the first wheel configured to roll on a rolling surface;

a first arm having a first end and a second end, and a midpoint, the first arm disposed in proximity to the front end of the housing, the first arm pivotally connected to the housing at about the midpoint of the first arm, the first end of the first arm connected to the front right leg of the body element and the second end of the first arm connected to the front left leg of the body element;

a second arm having a first end and a second end, and a midpoint, the second arm disposed in proximity to the rear end of the housing, the second arm pivotally connected to the housing at about the midpoint of the second arm, the first end of the second arm connected to the rear right leg of the body element and the second end of the second arm connected to the rear left leg of the body element; and a linkage between the first wheel and at least one of the first and second arms, wherein the linkage translates the rotational motion of the first wheel to back and forth substantially linear movement of the at least one of the first and second arms.

2. The animal walking toy apparatus of claim 1 wherein the linkage moves the first end of the at least one of the first and second arms forwardly and at the same time moves the second end of the at least one of the first and second arms rearwardly.

3. The animal walking toy apparatus of claim 1 wherein the linkage moves the first end of the at least one of the first and second arms rearwardly and at the same time moves the second end of the at least one of the first and second arms rearwardly.

4. The animal walking toy apparatus of claim 1 wherein the linkage translates the rotational motion of the first wheel to back and forth substantially linear movement of both the first and second arms.

5. The animal walking toy apparatus of claim 4 wherein the linkage moves, in a synchronized manner, the first end of the first arm forwardly, the second end of the first arm rearwardly, the second end of the second arm forwardly, and the first end of the second arm rearwardly.

6. The animal walking toy apparatus of claim 1 wherein the first wheel comprises a crank axle, and the linkage comprises:

a rocker disposed in about a midsection of the housing, the rocker having an extended element on a side thereof disposed in a slot of the housing, wherein the extended element moves within the slot of the housing;

a main link disposed between the crank axle and the rocker;

a first link disposed between the rocker and the first arm in proximity to the first side of the housing; and a second link disposed between the rocker and the second arm in proximity to the second side of the housing, wherein movement of the first wheel causes the crank axle to revolve, causing the main link to move the rocker, causing the first link to move the first end of the first arm in a first direction and the second link to move the second end of the second arm in the first direction.

7. The animal walking toy apparatus of claim 6 wherein the rocker comprises a pin that is attached to a side of the housing, wherein the rocker is rotatable about the pin, and further wherein the main link causes the rocker to rotate around the pin, wherein movement of the rocker causes the extended element to move within the slot of the housing, causing the first and second links to move.

8. The animal walking toy apparatus of claim 6 wherein movement of the first wheel sequentially moves the first end of the first arm and the second end of the second arm in the first direction, and the first end of the first and the second end of the second arm to move in a second direction, wherein the first direction and the second direction are opposite from each other.

9. The animal walking toy apparatus of claim 1 further comprising:

a second wheel adjacent the first wheel.

10. The animal walking toy apparatus of claim 1 wherein the first wheel sits between the front right leg and the front left leg.

11. The animal walking toy apparatus of claim 1 wherein the first wheel comprises a traction element for engaging the first wheel on a surface.

12. The animal walking toy apparatus of claim 1 further comprising:

a rigid or semi-rigid elongated leash element having a first end and a second end, the first end connected to the top of the body element and a second end having a handle.

13. The animal walking toy apparatus of claim 12 wherein the housing comprises a bracket extending through a top of the body element, wherein the elongated leash element is connected to the bracket.

14. The animal walking toy apparatus of claim 1 further comprising:

stiffeners located in the legs of the body element.

15. The animal walking toy apparatus of claim 1 wherein the legs are disposed a distance above the rolling surface.

16. The animal walking toy apparatus of claim 1 wherein each of the legs comprises a contact element configured to contact the rolling surface.

17. The animal walking toy apparatus of claim 16 wherein the contact element is selected from the group consisting of a plastic skid, a wheel, and a rolling ball.

18. The animal walking toy apparatus of claim 1 wherein the body element is removable from the housing so that a second body element may be disposed on the housing.

19. The animal walking toy apparatus of claim 1 further comprising:

a sound module.

20. The animal walking toy apparatus of claim 1 further comprising:

a self-propelling element for propelling the toy animal apparatus forwardly or rearwardly.

* * * * *